US008602637B2

(12) United States Patent
Queval

(10) Patent No.: US 8,602,637 B2
(45) Date of Patent: Dec. 10, 2013

(54) ANTI-TRIP DEVICE FOR AN ESCAPE MECHANISM

(75) Inventor: Arthur Queval, Neuchâtel (CH)

(73) Assignee: Nivarox-FAR S.A., Le Loche (CH)

( * ) Notice: Subject to any disclaimer, the term of this patent is extended or adjusted under 35 U.S.C. 154(b) by 120 days.

(21) Appl. No.: 13/271,734

(22) Filed: Oct. 12, 2011

(65) Prior Publication Data

US 2012/0113763 A1 May 10, 2012

(30) Foreign Application Priority Data

Nov. 4, 2010 (EP) ..... 10189998

(51) Int. Cl.
*G04B 15/00* (2006.01)
*G04B 15/14* (2006.01)

(52) U.S. Cl.
CPC ..... *G04B 15/14* (2013.01)
USPC ..... 368/127; 368/129

(58) Field of Classification Search
USPC ..... 368/127, 129–131
See application file for complete search history.

(56) References Cited

U.S. PATENT DOCUMENTS

| | | | | |
|---|---|---|---|---|
| 180,290 | A | 7/1876 | Voigt | |
| 2,526,620 | A * | 10/1950 | Jeanneret | 74/1.5 |
| 2006/0072376 | A1 * | 4/2006 | Gabus et al. | 368/127 |
| 2007/0140066 | A1 | 6/2007 | Lechot et al. | |

FOREIGN PATENT DOCUMENTS

| | | | |
|---|---|---|---|
| CH | 700 091 | A1 | 7/2010 |
| EP | 1 645 918 | A1 | 4/2006 |
| EP | 1 522 001 | B1 | 8/2006 |
| EP | 1 708 046 | A1 | 10/2006 |
| EP | 1 708 047 | A1 | 10/2006 |
| EP | 1 770 452 | A1 | 4/2007 |
| EP | 1 801 668 | A1 | 6/2007 |
| EP | 1 860 511 | A1 | 11/2007 |
| EP | 2 224 292 | A2 | 9/2010 |

OTHER PUBLICATIONS

European Search Report of EP 10 18 9998 dated May 4, 2011.

* cited by examiner

*Primary Examiner* — Amy Cohen Johnson
*Assistant Examiner* — Matthew Powell
(74) *Attorney, Agent, or Firm* — Sughrue Mion, PLLC

(57) ABSTRACT

The invention concerns an anti-trip device (1) for an escape mechanism (10) arranged to cooperate with a balance (2) pivoting about a first axis (D1).

It includes a pivoting wheel set (5), pivotally moveable about a second axis (D2) parallel to said first axis (D1) and fixed relative to a plate. The pivoting wheel set (5) includes guide means (7) arranged to cooperate with complementary guide means (9) comprised in a roller (3) pivoting integrally with said balance (2).

Said complementary guide means (9) includes a cam (90) for moving said pivoting wheel set (5) closer to said first axis (D1) when said balance is pivoting in a first direction (B1) and to move said wheel set away from said first arbour when the balance is pivoting in a second direction (B2) opposite to said first direction (B1). Said guide means (7) includes a fixed finger arranged to cooperate with said cam.

18 Claims, 3 Drawing Sheets

ANTI-TRIP DEVICE FOR AN ESCAPE MECHANISM

This application claims priority from European Patent Application No. 10189996.1 filed Nov. 4, 2010, the entire disclosure of which is incorporated herein by reference.

FIELD OF THE INVENTION

The invention concerns an anti-trip device for an escape mechanism arranged to cooperate with a balance pivoting about a first pivot axis whose position is fixed relative to a plate.

The invention also concerns an escape mechanism including at least one balance, pivotally moveable relative to a plate and pivoting about a balance axis.

The invention also concerns a timepiece movement including at least one such escape mechanism.

The invention also concerns a timepiece including at least one timepiece movement and/or at least one escape mechanism of this type.

The invention concerns the field of horology, in particular the field of escape mechanisms, and more specifically the field of detent escapements.

BACKGROUND OF THE INVENTION

Detent escape mechanisms are reputed to be the most precise, and have long been reserved for marine chronometers.

The efficiency of detent escape mechanisms is greater than that of lever escapements, because the escape wheel only communicates an impulse to the balance once per oscillation, during which the escape wheel pivots through one angular step. Consequently, the loss of energy due to the inertia of the escape wheel occurs once per oscillation, as opposed to once per vibration in lever escapements.

The use of detent escapements in wristwatches is more complex, because of the sensitivity of such escapements to shocks.

In the event of shocks, particularly lateral shocks, if the balance is made to pivot outside its normal amplitude, one tooth of the escape wheel may leave the locking pallet stone, and unlocking and impulses occur twice in the same vibration. The effect of this phenomenon, called "tripping", is to distort the isochronism of the oscillator.

EP Patent No. 1 708, 047 in the name of MONTRES BREGUET SA discloses a lever including an arm carrying both a first finger for cooperating with the second actuating finger, and a feeler with a beak cooperating with a notched cam similar to the preceding ones. When the balance and the plates thereof pivot in a first direction, the first finger drives the second finger to release the locking pallet stone(s) from the escape wheel. The beak of the feeler arm is then driven by a leading flank of the notched cam to re-engage the locking means in the escape wheel. When the balance pivots in the opposite direction, the first finger drives the second finger to keep the locking means engaged in the escape wheel. Whatever the direction in which the plates are pivoting, the encounter between the first and second finger generates a natural rotating force on the lever arbour. This encounter does not generate any risk of breaking the mechanism. No resilient member or stop pins are necessary. In a particular embodiment, this mechanism includes two juxtaposed locking pallet stones including contiguous but not aligned locking faces, which enables the tip of the escape wheel tooth to be housed on a locking line at the junction of the locking faces, creating a draw effect which dispenses with the need for any stop pin.

The locking face of the closest locking pallet stone to the escape wheel stands in front of the tooth, and prevents it from continuing on its way. In this total lock position of the escape wheel tooth, the beak of the feeler arm moves away from the periphery of the roller leaving the balance completely free to complete the first vibration. This design makes the escapement resistant to shocks. Indeed, a shock returns the beak onto the periphery of the corresponding roller, without however unlocking the locking pallet stones, since the return of the tooth onto the locking line occurs immediately owing to the draw effect. When, afterwards, during the return movement of the balance in the opposite direction, towards the end of the second vibration, the first finger and the second finger come into cooperation, they give rise to torque in the detent lever around its pivot axis, causing a slight withdrawal of the escape wheel tooth, before, when the fingers separate, the tooth returns to the locking line in an anti-draw effect.

EP Patent No. 1 708 046 in the name of MONTRES BREGUET SA discloses a safety finger secured to the balance roller, and arranged to cooperate with the escape wheel teeth and lock the wheel if the impulse pallet stone should be accidentally released from the toothing of the wheel. This arrangement prevents any disconnection of the escape wheel in the event of a shock resulting in a reversal of the direction of rotation of the plates at the precise moment of the wheel impulse. The encounter of one tooth of the wheel with this security finger locks the wheel and returns the plates to the proper direction of rotation.

EP Patent No 1 522 001 in the name of Detra SA and Patek Philippe SA proposes an escape mechanism with locking parts and toothed wheels with gaps in the toothing. The first wheel set is subjected to a periodic torque, obtained for example by a rotor mounted in a stator. This first wheel set includes, on the one hand, in a basic plane, a first wheel with gaps in the toothing over the periphery thereof, and on the other hand, in a second plane, a first brake-lever including several teeth and able to lock a release lever comprised in a balance roller, when the balance pivots in a first direction. Depending upon its position, this first wheel set cooperates with a second wheel set, either via the first brake-lever or via the first wheel thereof. This second wheel set includes, in the basic plane, a second wheel with toothing gaps, in the second plane, a shaped part which includes several fingers and can lock the balance roller release lever in a second direction of pivoting opposite to the first direction. The second wheel set further includes a locking part in a first plane parallel to the preceding planes. Depending upon its position, this second wheel set cooperates, either via the locking part, or via the second wheel thereof, with an escape wheel, which includes, in the basic plane, a toothed wheel with toothing gaps, and in the first plane, an impulse wheel, which receives a continuous mechanical torque such as that from a barrel, similar to a conventional escape wheel, and can cooperate with the impulse lever comprised in the balance roller, to maintain the oscillating movement of the balance. Depending upon the respective angular positions of the various wheel sets, the locking parts, or shaped parts, or teeth, cooperate with each other, such that the device has four stable locking positions for each revolution of the first pin, between which it has the same number of unlocking positions. The combination of two locking means and two unlocking means for the mechanical torque, and the particular sequence imposing an unlocking operation between two locking operations prevent any racing or tripping in the event of a shock to the mechanism. This mechanism is complex, relatively expensive and extends over several planes, which gives it significant thickness.

EP Patent No. 1 770 452 in the name of Baumberger Peter is an improvement of the Voigt U.S. Pat. No. 180,290 devised to minimise the requirement for space, and it discloses a conventional detent escapement with a detent lever that pivots and is returned by a spiral spring. One arm of the lever carries one end of a strip spring, the other end of which is held abutting on a stop member carried by another arm of the lever, and is arranged to cooperate with a unlocking pallet-stone integral with a small balance roller. Another arm of the lever, beyond a locking pallet stone, includes a finger which cooperates with the periphery of this small roller, and in particular with a truncated portion forming a cam, at a lower level than that of the strip spring. A large balance roller conventionally carries an impulse pallet stone, preceded by a first recess, and followed by a second recess, to allow the locking pallet stone to be unlocked when the unlocking pallet-stone pivots the detent lever. The selection of a particular geometry, both as regards the position of the locking pallet stone and the impulse pallet stone in quasi-symmetry with the line at the centres of the escape wheel and the balance during the locking phase, and the fork formed by the finger and the free end of the strip spring, limit the disruptive effect linked to the detent inertia on the balance oscillations. The amplitude of the pivoting movements of the detent, in the event of shock, is limited by the interaction of the locking pallet stone and the large roller. In a complementary embodiment, this mechanism includes an anti-trip lever, in proximity to the small roller, pivotably mounted on the movement between two stable end positions maintained by a jumper spring on stop members with which a first end can cooperate and the second fork-shaped end of which interacts with the unlocking pallet-stone: each time the unlocking pallet-stone passes into the fork it exerts pressure to tip the anti-trip lever from one stable position to the other. The fork thus forms two stops for the small roller in the event of any tripping, and prevents the balance from pivoting through more than one revolution.

EP Patent No. 1 860 511 in the name of Christophe Claret SA discloses a movement with a moveable bridge, providing protection for a detent escapement against lateral shocks. This moveable bridge carries the sprung-balance pivot axis, the escape wheel pivot axis, the detent pivot axis and part of the gear train. It is pivoted elastically on the arbour of one of the gear train wheels, for example the seconds wheel. Forces, such as a lateral shock, capable of unlocking the locking pallet stone, then drive the entire moveable bridge and the relative positions of the detent and the escape wheel are maintained. This ensures constant operation of the escapement. The moveable bridge may also be dampened by a dampening system which dissipates part of the energy due to the shock.

CH Patent Application No 700 091 in the name of Christophe Claret SA discloses a detent escapement, with a detent lever pivotably mounted on a spiral spring cooperating at the other end with a first strip spring embedded in proximity to the pivot. The balance roller includes two distinct unlocking pallet stones. A wheel set arranged on the opposite side of the escape wheel relative to the detent lever, carries a pivoting cam, holding a cam strip spring and returned towards the detent by a spiral spring on a stop position. This cam is arranged for making the cam strip spring cooperate, either in a first state, with the end of the lever carrying the strip spring, or in a second state, with the unlocking pallet stones of the balance. The first unlocking pallet-stone is arranged to cooperate with the first strip spring and actuate the detent when the first pallet stone encounters the first strip in a first direction, and to cooperate only with the first strip without actuating the detent when it encounters the first strip in the opposite direction. When the cam is in the first state it cooperates with the detent to limit the movements thereof. The second unlocking pallet-stone stone is arranged for changing the cam to the second state in which the detent is free to perform its unlocking operation and release the escape wheel tooth from the locking pallet stone. The two unlocking pallet stones are close and arranged such that the cam is brought into its second state just before the detent performs the unlocking operation. The spiral cam return spring, which is stronger than the cam strip spring, tends to return the cam to its first state. Thus, in the first state thereof, the cam is positioned so as to oppose any inadvertent movement of the detent which could result in inadvertent unlocking of the locking pallet stone, and the escapement is less sensitive to the effects of a shock. Adjustment of this mechanism is complex, since it depends upon the features peculiar to the springs comprised therein, of which there are at least three.

EP Patent No. 2 224 292 in the name of Rolex SA discloses a direct impulse escapement, particularly a detent escapement. The detent lever is arranged in a particular manner, pivoting between two stop members. Facing the escape wheel, it includes a finger including, in succession, a stop surface used as the locking pallet stone, a safety surface which, depending upon the pivotal position of the lever, either interferes or does not interfere with the escape wheel trajectory, and a sliding surface which forces the lever to tip, when the escape wheel is pivoting, so as to return the sliding surface and thus the stop surface to the area of interference with the escape wheel, to stop said wheel pivoting. The balance roller conventionally includes an impulse pallet stone and an unlocking finger. During the vibration in a first pivoting direction of the balance, the lever is in a first stopped pivotal position which allows the unlocking finger to pass, whereas in the other vibration in the other pivoting direction, the lever is pivoted into another stop position and encounters the unlocking finger at an elastic unlocking element comprised in said lever. The elastic travel of this elastic unlocking element allows the balance to continue its travel and the impulse pallet stone passes between two adjacent teeth of the escape wheel. Shortly afterwards, the balance is stopped by the balance spring thereof and pivots in the opposite direction. During this elastic travel, the lever remains butting against the stop member and the stop surface of the lever slides over the escape wheel tooth which is kept stopped. The safety of this mechanism is ensured by the arrangement of the lever finger, with one stop surface and one sliding surface which alternately run into the trajectory of the escape wheel toothing. The length of the safety surface between the stop surface and the sliding surface corresponds to the angle travelled by the wheel to communicate the drive energy to the balance, to prevent the premature return of the stop element into the trajectory of the wheel, which provides additional security. Part of the energy from the barrel is, however, consumed in friction during the sliding phase.

Few Patent documents are specifically dedicated to anti-trip mechanisms.

EP Patent No. 1 645 918 in the name of MONTRES BREGUET SA discloses a mechanism of this type, including a finger secured to an arm of the balance. The balance cock includes two columns, between which this finger can pass. A locking arm is secured to the outer coil of the balance spring, particularly by clamping, and when the balance tends to race under the effect of a shock and exceed its normal amplitude, the arm can abut on the columns to prevent the finger from passing.

EP Patent No. 1 801 668 in the name of MONTRES BREGUET SA discloses an arrangement of a balance axis fitted with a pinion, which cooperates with a toothed sector that can move between two stop positions and prevents the balance from pivoting beyond its normal amplitude.

In short, known embodiments are often complex and difficult to adapt from one escape mechanism to another. The method of stopping the balance is generally very abrupt and does not always ensure that the movement will restart without intervention.

SUMMARY OF THE INVENTION

The invention proposes to overcome the shortcomings of the prior art, by proposing a mechanism which is simple and reliable, inexpensive and easy to adapt to existing escape mechanisms.

The invention therefore concerns an anti-trip device for an escape mechanism arranged to cooperate with a balance pivoting about a first pivot axis whose position is fixed relative to a plate, characterized in that said device includes a pivoting wheel set, pivotally moveable about a second pivot axis parallel to said first pivot axis and in a fixed position relative to said plate, said pivoting wheel set including guide means arranged for cooperating with complementary guide means comprised in a roller arranged to be secured to said balance and pivoting integrally therewith, and further characterized in that said guide means, or respectively said complementary guide means, includes a cam arranged to move said pivoting wheel set closer to said first pivot axis when said balance is pivoting in a first direction of pivoting, and to move said pivoting wheel set away from said first pivot axis when said balance is pivoting in a second direction of pivoting opposite to said first direction of pivoting, whereas said complementary guide means, or respectively said guide means includes a fixed finger arranged to cooperate with said cam.

According to a feature of the invention, said cam is limited by a first limit stop member in proximity to the pivot axis of the component that carries said cam, and by a second limit stop member further away than said first limit stop member from the pivot axis of the component which carries said cam, so as to immobilise said balance when said first limit stop member or said second limit stop member is reached.

According to another feature of the invention, said complementary guide means includes a cam track arranged with a radius that increases radially, or with a radius that increases with radially increasing steps, about said first pivot axis and said guide means includes a pin forming a finger arranged to cooperate with said cam track.

The invention further includes an escape mechanism including at least one balance, pivotally moveable relative to a plate and pivoting about a balance axis, characterized in that the mechanism is a detent escape mechanism, and in that it includes an anti-trip device of this type, wherein said pivoting wheel set is mounted to pivot about a second pivot axis parallel to said first pivot axis and in a fixed position relative to said plate.

The invention also concerns a timepiece movement including at least one such escape mechanism.

The invention also concerns a timepiece including at least one timepiece movement and/or at least one escape mechanism of this type.

BRIEF DESCRIPTION OF THE DRAWINGS

Other features and advantages of the invention will appear more clearly upon reading the following detailed description, with reference to the annexed drawings, in which.

DETAILED DESCRIPTION OF PREFERRED EMBODIMENTS

Figure 1:
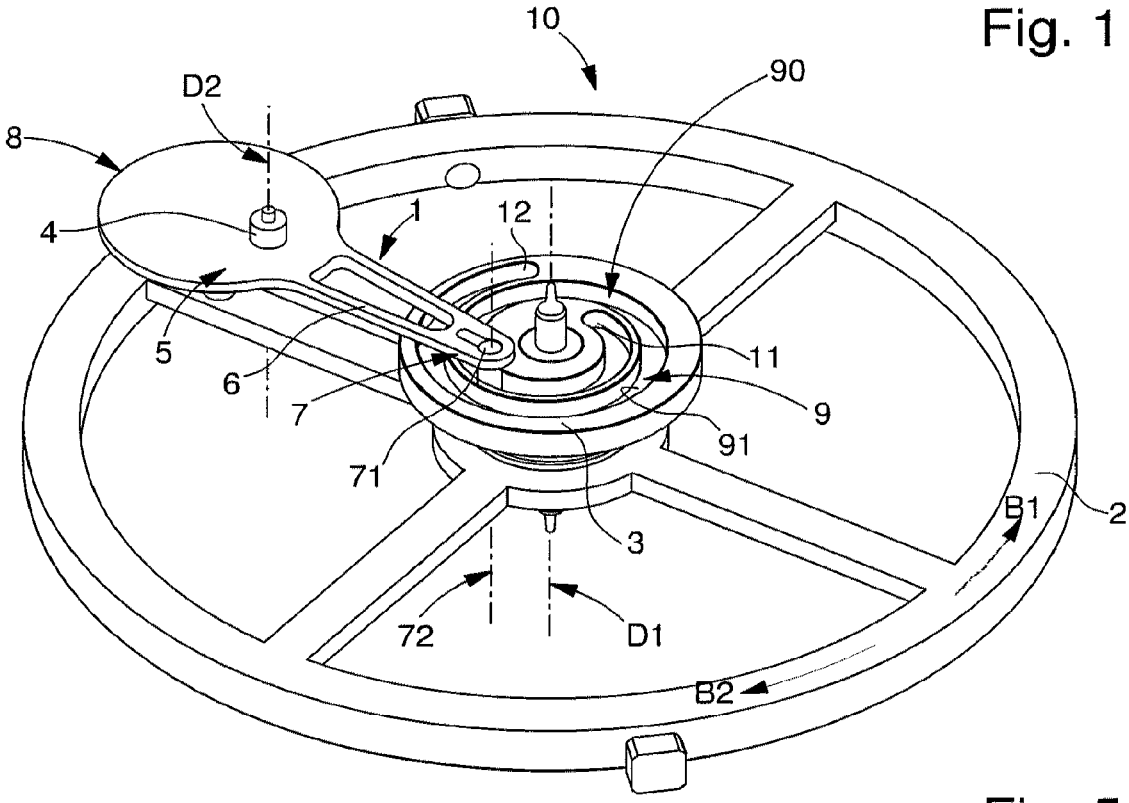
FIG. 1 shows a schematic perspective view of an anti-trip device according to the invention, in a rest position, associated with a balance and a plate which is not shown.

The invention concerns the field of horology.

The invention concerns an anti-trip device 1 for an escape mechanism 10 which is arranged to cooperate with a balance 2 pivoting about a first pivot axis D1 whose position is fixed relative to a plate.

According to the invention, device 1 includes a pivoting wheel set 5, which is pivotally moveable about a second pivot axis D parallel to said first pivot axis D1 and whose position is fixed relative to the plate.

This wheel set 5 includes guide means 7, which is arranged to cooperate with complementary guide means 9 comprised in a roller 3 arranged to be secured to the balance 2 to pivot integrally therewith.

Guide means 7 or respectively complementary guide means 9 in another embodiment, includes a cam 90, which is arranged to move pivoting wheel set 5 closer to the first pivot axis D1 when the balance is pivoting in a first direction of pivoting B1, and to move pivoting wheel set 5 away from first pivot axis D1 when the balance is pivoting in a second direction of pivoting B2 opposite to the first direction of pivoting B1.

Complementary guide means 9, or respectively guide means 7, includes a fixed finger arranged to cooperate with cam 90.

In the preferred embodiment, illustrated in the Figures, and explained in detail hereinafter, cam 90 is carried by roller 3 secured to balance 2. However the opposite configuration is also possible.

Cam 90 is limited on either side, on the one hand by a first limit stop member 11 in proximity to the pivot axis of the component that carries cam 90, and on the other hand by a second limit stop member 12 further away than the first limit stop member from the pivot axis of the component that carries cam 90, so as to immobilise balance 2 when first limit stop member 11 or second limit stop member 12 is reached.

In a position in which balance 2 is stopped when first limit stop member 11 or second limit stop member 12 is reached, the tangent T to the median profile of cam 90 at first limit stop member 11 and at second limit stop member 12 passes through the second pivot axis D2 so as to block the pivoting of balance 2 about its pivot axis D1. In the embodiment of the Figures, guide means 7 is a wheel set pin 71, which runs along a cam track 91 of cam 9, formed by a groove arranged in roller 3.

Figure 4:
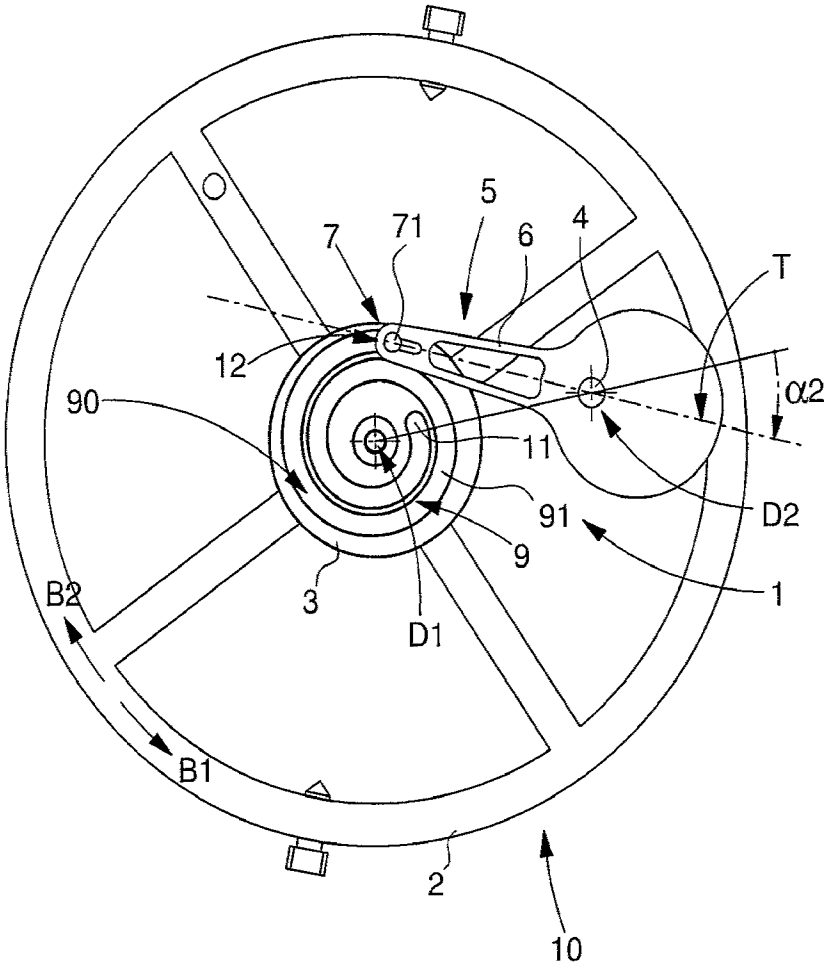
FIG. 4 shows a schematic front view of the anti-trip device of FIG. 1 in a second limit stop position opposite to the preceding position.
Figure 3:
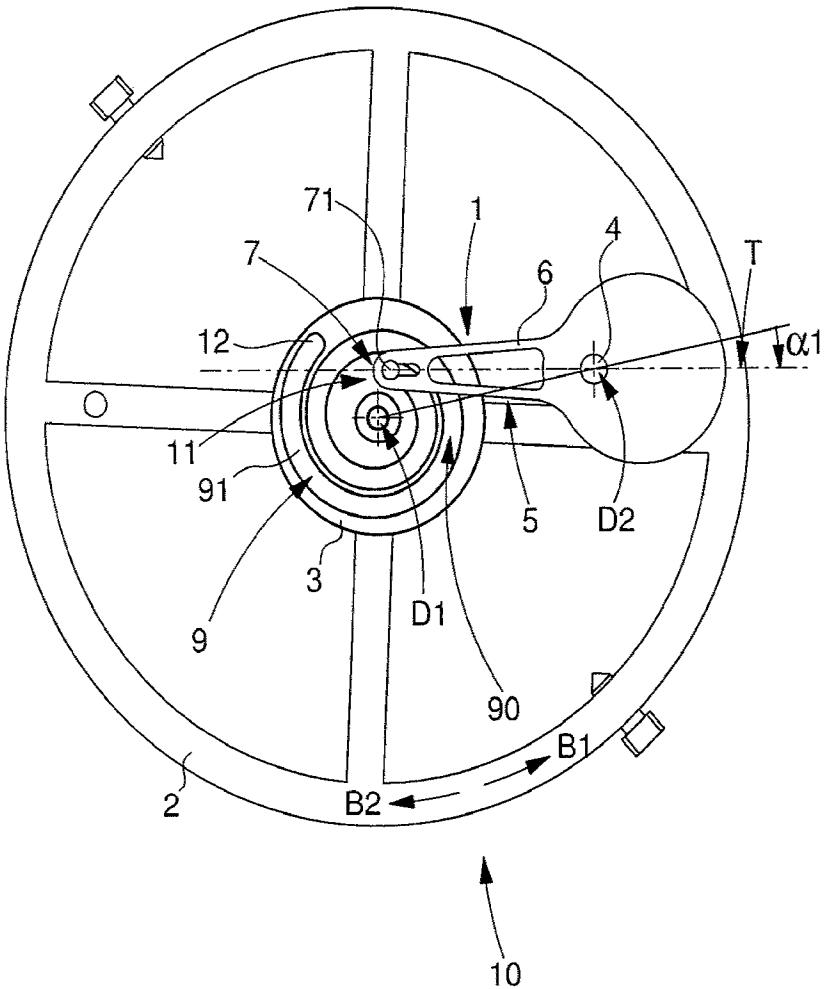
FIG. 3 shows a schematic front view of the anti-trip device of FIG. 1 in a first limit stop position.

The tangent T thus passes through arbour 4 which forms the pivot of pivoting wheel set 5 along pivot axis D2, as seen in FIGS. 3 and 4.

This particular arrangement means that the direction of the force vector exerted by the balance as it reaches a stop on wheel set pin 71 via one of the two limit stop members 11 or 12 can pass through this arbour and thus create zero torque on pivoting wheel set 5, while blocking the pivoting of balance 2, thereby preventing the balance from performing any additional revolution in the event of a shock.

Preferably, complementary guide means 9 includes a cam track 91 arranged with a radius that increases radially or with a radius that increases with radially increasing steps, about first pivot axis D1, and guide means 7 includes a pin 71 forming a finger and arranged to cooperate with cam track 91.

Figure 2:
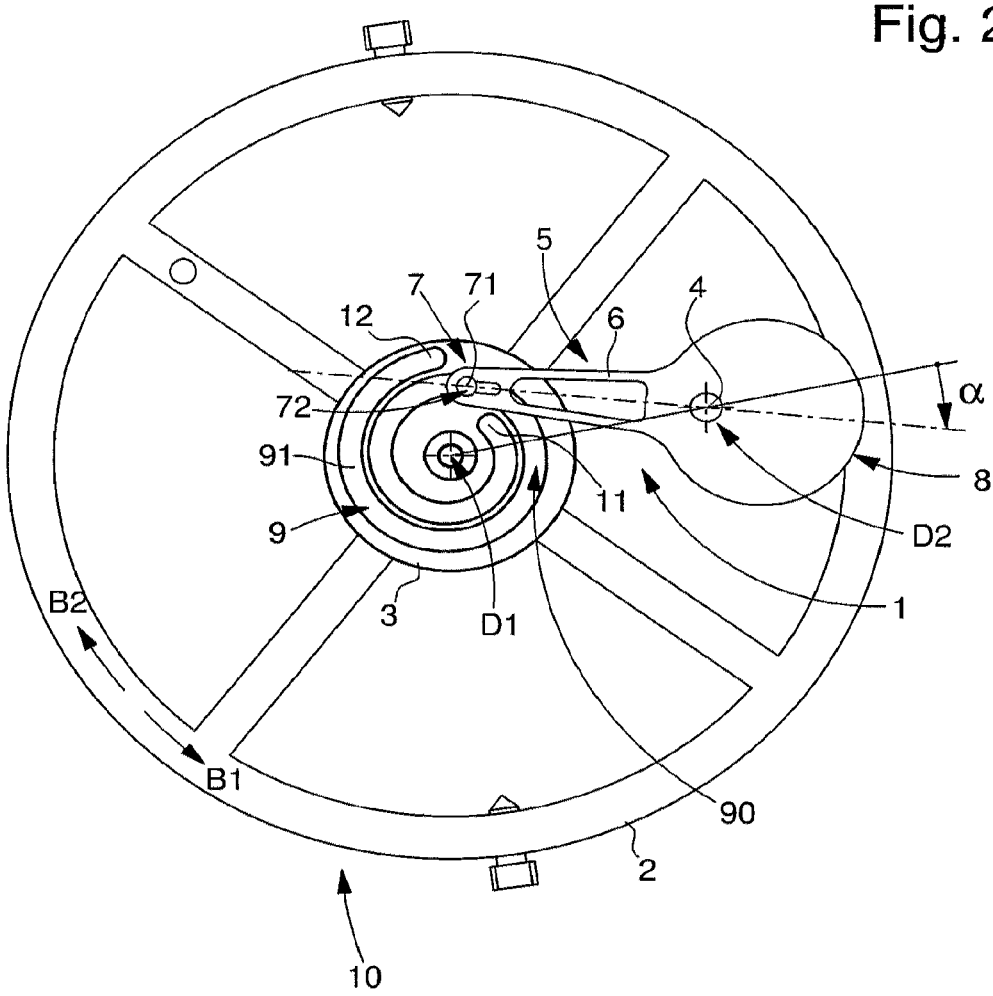
FIG. 2 shows a schematic front view of the anti-trip device of FIG. 1, in the same position.

To minimise friction, pin 71 can move with a radial play J in cam track 91. A tribological surface treatment on cam track 91 and/or pin 71 may also advantageously reduce friction. Indeed, anti-trip device 1 is only of use if there is a shock and balance 2 races. In normal mode, i.e. in a rest position in which pin 71 occupies an intermediate position between stop members 11 and 12 as seen in FIG. 1 or 2; anti-trip device 1 should consume the least possible amount of energy.

In a particular embodiment, as seen in FIGS. 1 to 4, cam 90 includes a cam track 91 in a spiral about first pivot axis D1.

Advantageously, this spiral is sized and positioned relative to pivot axis D2 such that a straight line joining the second pivot axis D2 to an arbour 72 comprised in guide means 7 is tangential to the median profile of the spiral in any position of guide means 7.

Figure 5:
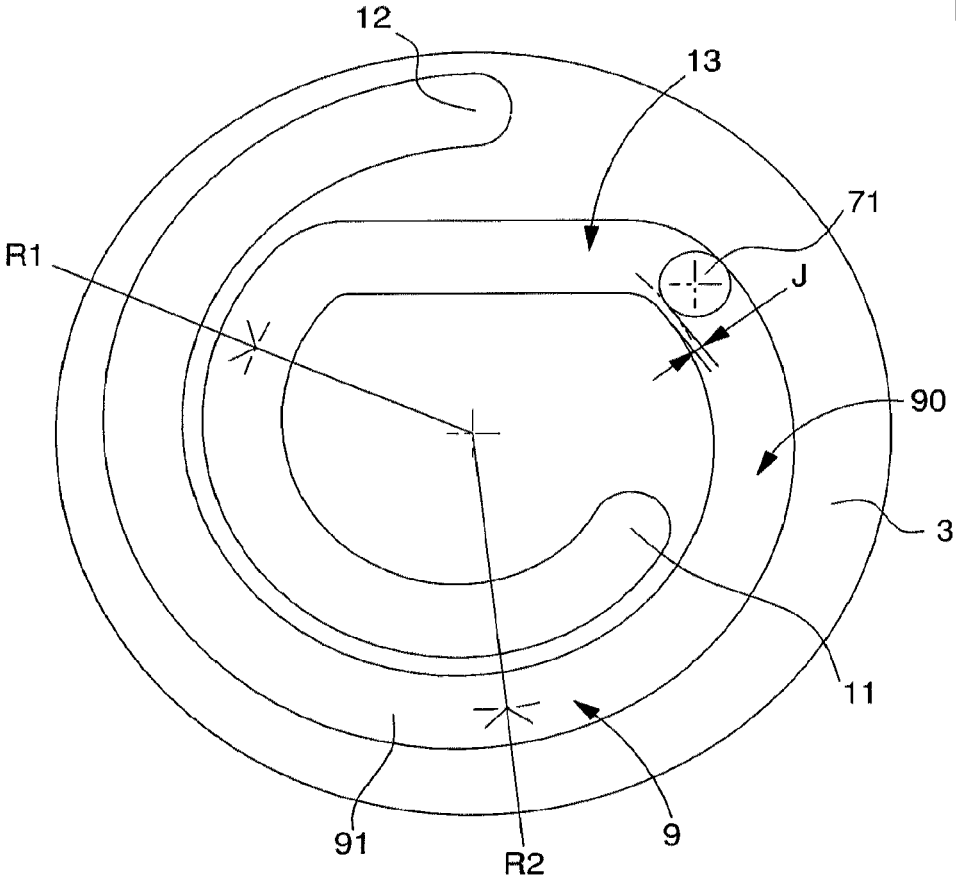
FIG. 5 shows a schematic front view of a roller comprised in an anti-trip device according to the invention, in another variant.

In another particular embodiment, as seen in FIG. 5, cam 90 includes a cam track 91 including several circular sections of revolution about first pivot axis D1 connected in pairs by a transition zone 13 whose radius increases radially. FIG. 5 thus shows two zones having respective radii R1 and R2. It is clear that, when pin 71 travels through these sections of revolution about pivot axis D1, it is not subjected to any radial stress, and friction losses are minimal or even zero.

Advantageously, pivoting wheel set 5 includes a balancing zone 8, which is arranged to balance, preferably dynamically, pivoting wheel set 5 about the second pivot axis D2, up to a maximum pivoting angular velocity. This maximum pivoting angular velocity, at which the pivoting wheel set is dynamically balanced about second pivot axis D2, is determined by the pivoting angular velocity of balance 2 about the first pivot axis D1 on the one hand, and on the other hand by the combination of a first constant lever arm formed by the distance between the second pivot axis D2 and an arbour 72 comprised in guide means 7 and a second variable lever arm formed by the distance between the first pivot axis D1 and arbour 72. In an alternative embodiment, the balancing zone 8 is defined by simple static balancing of pivoting wheel set 5 about second pivot axis D2.

Preferably, for the sake of lightness, good elasticity and ease of manufacture, pivoting wheel set 5 and/or roller 3 is made in a micro-machinable material, or silicon, or quartz or a compound thereof, or an alloy derived from MEMS technology, or an alloy such as that obtained by the DRIE or LIGA methods, or in an at least partially amorphous material. To improve shock resistance, the areas of pivoting wheel set 5 and roller 3 subjected to shocks when the balance races may be arranged as shown in FIGS. 6 and 7.

Figure 6:
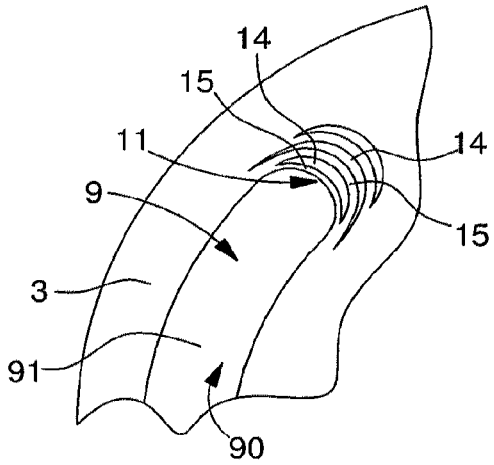
FIGS. 6 and 7 show schematic partial plan views of the arrangement, in a particular embodiment of the area around the stop surfaces respectively of a balance roller and a pivoting wheel set comprised in the anti-trip device according to the invention.

Thus, in proximity to both first limit stop member 11 and second limit stop member 12, roller 3 of FIG. 6 has at least one chamber 14 defining at least one elastic partition 15 arranged to absorb tangential stress in the event of a shock, and thus prevent any deterioration in the structure concerned, or has, as shown, a plurality of such chambers 14, which may or may not have an opening, defining elastic partitions 15 arranged to absorb tangential stress in the event of a shock.

Figure 7:
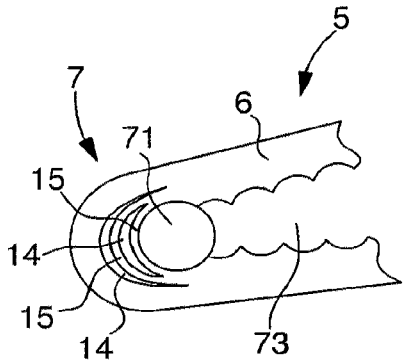

FIG. 7 shows the end of an arm 6 comprised in pivoting wheel set 5. This arm 6 is similarly provided with at least one chamber 14 defining at least one elastic partition 15 arranged to absorb tangential stress in the event of a shock, or a plurality of such chambers 14 defining elastic partitions 15. In this Figure, the wheel set pin 71 is shown fixed in a groove 73 which may include pre-machined recesses for adapting the positioning of pin 71 according to the escapement to which pivoting wheel set 5 is fitted, and depending upon the roller 3 used.

In variants that are not shown in the Figures, these elastic partitions may also be arranged in proximity to the centre of the balance spring, or on the actual finger.

In a variant that is not shown in the Figures, pivoting wheel set 5 includes an arm with a bistable lever, wherein each of the two stable positions is maintained either by cooperation between a notch and elastic return means such as a spring, or by cooperation between one magnet and another magnet or a pallet stone made of magnetic material such as soft iron or suchlike.

In another embodiment this bistable lever includes electrostatic return means such electrets in each of said two stable position.

The pivoting wheel set may thus be on an elastic pivot, and include a bistable elastic strip, for example with two concave radii for defining two stable positions.

The invention also concerns an escape mechanism 10 including at least one balance 2, pivotally moveable relative to a plate and pivoting about a balance axis D1. Preferably, this mechanism 10 is a detent escape mechanism, and includes an anti-trip device 1 according to the invention, wherein the pivoting wheel set 5 is pivotably mounted about a second pivot axis D2 which is parallel to first pivot axis D1 and whose position is fixed relative to the plate.

In a particular embodiment, roller 3 is made in a single piece with balance 2.

In an advantageous embodiment of this escape mechanism 10, the unit formed of balance 2 and roller 3 is preferably in a single piece and is made of micro-machinable material, or silicon, or quartz or a compound thereof, or an alloy derived from MEMS technology, or an alloy obtained via the DRIE or LIGA methods, or made of an at least partially amorphous material. This unit may also be made in a single piece with a balance spring, as disclosed in EP Patent No. 2 104 008 in the name of the Applicant.

The invention also concerns a timepiece movement including at least one such escape mechanism 10.

The invention also concerns a timepiece including at least one timepiece movement of this type, and/or at least one escape mechanism 10 of this type.

The invention thus offers a reliable solution, which is easy to implement and has the advantage of being applicable to any existing detent escapement model at the cost of minor alterations, consisting in securing a roller to the balance axis and securing a pivoting wheel set to the plate.

What is claimed is:

1. An anti-trip device for an escape mechanism arranged to cooperate with a balance pivoting about a first pivot axis whose position is fixed relative to a plate, wherein said device includes a pivoting wheel set, pivotally moveable about a second pivot axis parallel to said first pivot axis and in a fixed position relative to said plate, said pivoting wheel set including guide means, said device also including a roller arranged to be secured to said balance and to pivot integrally therewith, said roller including complementary guide means arranged to cooperate with said guide means, and further wherein said guide means, or respectively said complementary guide means, includes a cam arranged to move said pivoting wheel set closer to said first pivot axis when said balance is pivoting in a first direction of pivoting, and to move said pivoting wheel set away from said first pivot axis when said balance is pivoting in a second direction of pivoting opposite to said first direction of pivoting, whereas said complementary guide means, or respectively said guide means includes a fixed finger arranged to cooperate with said cam.

2. The anti-trip device according to claim 1, wherein said cam is limited by a first limit stop member in proximity to the pivot axis of the component that carries said cam, and by a second limit stop member further away than said first limit stop member from the pivot axis of the component which carries said cam, so as to immobilise said balance when said first limit stop member or said second limit stop member is reached.

3. The anti-trip device according to claim 2, wherein, in a position in which said balance is stopped when said first limit stop member or said second limit stop member is reached, the tangent to the median profile of said cam at said first limit stop member and at said second limit stop member passes through the pivot axis of the component that carries said cam so as to block the pivoting of said balance about the pivot axis thereof.

4. The anti-trip device according to claim 2, wherein said roller includes, in proximity to each of said first limit stop member and second limit stop member, at least one chamber defining at least one elastic partition arranged to absorb tangential stress in the event of a shock.

5. The anti-trip device according to claim 1, wherein said complementary guide means includes a cam track arranged with a radius that increases radially or with a radius that increases with radially increasing steps, about said first pivot axis, and wherein said guide means includes a pin forming a finger and arranged to cooperate with said cam track.

6. The anti-trip device according to claim 5, wherein said pin can move with a radial play in said cam track.

7. The anti-trip device according to claim 5, wherein said cam includes a cam track in a spiral about said first pivot axis.

8. The anti-trip device according to claim 7, wherein a straight line joining said second pivot axis to an arbour comprised in said guide means is tangential to the median profile of said spiral in any position of said guide means.

9. The anti-trip device according to claim 5, wherein said cam includes a cam track including several circular sections of revolution about said first pivot axis connected in pairs by a transition zone whose radius increases radially.

10. The anti-trip device according to claim 1, wherein said pivoting wheel set includes a balancing zone arranged for dynamically balancing said pivoting wheel set about said second pivot axis up to a maximum pivoting angular velocity determined by the pivoting angular velocity of said balance about said first pivot axis on the one hand, and on the other hand by the combination of a first constant lever arm formed by the distance between said second pivot axis and an arbour comprised in said guide means and a second variable lever arm formed by the distance between said first pivot axis and said arbour.

11. The anti-trip device according to claim 1, wherein said pivoting wheel set includes, in proximity to said guide means, at least one chamber defining at least one elastic partition arranged to absorb tangential stress in the event of a shock.

12. The anti-trip device according to claim 1, wherein said pivoting wheel set and/or said roller is made of silicon, or quartz, or a compound thereof, or of an at least partially amorphous material.

13. An escape mechanism comprising said anti-trip device according to claim 1, at least a balance pivotally moveable relative to a plate and pivoting about a balance axis, wherein the mechanism is a detent escape mechanism, and wherein said pivoting wheel set is mounted to pivot about a second pivot axis parallel to said first pivot axis and in a fixed position relative to said plate.

14. The escape mechanism according to claim 13, wherein said roller is made in a single piece with said balance.

15. The escape mechanism according to claim 14, wherein said unit formed of said balance and said roller is made of silicon, or quartz or a compound thereof, or of an at least partially amorphous material.

16. A timepiece movement including at least one escape mechanism according to claim 13.

17. A timepiece including at least one timepiece movement according to claim 16.

18. A timepiece including at least one escape mechanism according to claim 13.

* * * * *